US006428459B2

(12) United States Patent
Campbell, Jr.

(10) Patent No.: US 6,428,459 B2
(45) Date of Patent: Aug. 6, 2002

(54) PROTECTIVE BAG FOR SHIPMENT AND STORAGE OF ARTICLES OF EQUIPMENT AND METHOD OF FABRICATING SAME

(76) Inventor: Robert L. Campbell, Jr., 909 14th Ave., NW., Hickory, NC (US) 28601

( * ) Notice: Subject to any disclaimer, the term of this patent is extended or adjusted under 35 U.S.C. 154(b) by 0 days.

(21) Appl. No.: 09/769,625

(22) Filed: Jan. 25, 2001

Related U.S. Application Data

(62) Division of application No. 09/384,630, filed on Aug. 27, 1999, now Pat. No. 6,189,692, which is a division of application No. 09/061,776, filed on Apr. 16, 1998, now Pat. No. 6,006,905.

(51) Int. Cl.[7] ..... B31F 7/00

(52) U.S. Cl. ..... 493/352; 493/350; 493/904; 493/407

(58) Field of Search ..... 493/352, 350, 493/904, 407, 925, 919, 222; 206/326, 586, 778; 29/91

(56) References Cited

U.S. PATENT DOCUMENTS

| | | | | |
|---|---|---|---|---|
| 1,770,865 | A | | 7/1930 | Royal |
| 1,814,967 | A | | 7/1931 | Royal |
| 1,989,794 | A | | 2/1935 | Duvall |
| 2,121,259 | A | | 8/1938 | Scott |
| 2,265,075 | A | | 12/1941 | Knuetter |
| 2,474,770 | A | | 6/1949 | Young et al. |
| 2,805,973 | A | | 9/1957 | Klasing et al. |
| 2,897,109 | A | | 7/1959 | Voigtman |
| 3,044,429 | A | | 7/1962 | Levi |
| 3,044,517 | A | | 7/1962 | Levi |
| 3,111,154 | A | | 11/1963 | Levi |
| 3,248,040 | A | | 4/1966 | Friedman |
| 3,506,049 | A | | 4/1970 | Gerard |
| 3,576,059 | A | * | 4/1971 | Pearson ..... 29/91 |
| 3,669,252 | A | | 6/1972 | Evans |
| 3,734,394 | A | | 5/1973 | Dooley |
| 3,744,360 | A | | 7/1973 | Currie et al. |
| 3,750,872 | A | | 8/1973 | Bobb |
| 3,827,341 | A | | 8/1974 | Stage |
| 3,891,138 | A | | 6/1975 | Glas |
| 3,938,661 | A | | 2/1976 | Carmody |
| 3,948,436 | A | | 4/1976 | Bambara |
| 3,986,661 | A | | 10/1976 | Dreher |
| 4,011,798 | A | | 3/1977 | Bambara et al. |
| 4,385,427 | A | * | 5/1983 | Fraiser ..... 29/91 |
| 4,507,163 | A | | 3/1985 | Menard |
| 4,878,765 | A | | 11/1989 | Watkins et al. |
| 4,878,974 | A | | 11/1989 | Kagawa |
| 4,937,131 | A | | 6/1990 | Baldacci et al. |
| 4,987,997 | A | | 1/1991 | Raszewski et al. |
| 5,057,169 | A | | 10/1991 | Adelman |
| 5,143,133 | A | | 9/1992 | Speckman |
| 5,188,581 | A | | 2/1993 | Baldacci |
| 5,407,078 | A | | 4/1995 | Strauser |
| 5,465,842 | A | | 11/1995 | Utley |
| 5,474,185 | A | | 12/1995 | Franke |
| 5,701,999 | A | | 12/1997 | Phillips, II et al. |
| 5,881,883 | A | | 3/1999 | Siegelman |
| 5,882,776 | A | | 3/1999 | Bambara et al. |

OTHER PUBLICATIONS

Tennec0 Packaging brochure entitled "The Best All–Around Protection for York Furniture".

* cited by examiner

*Primary Examiner*—Rinaldi I. Rada
*Assistant Examiner*—Sameh Tawfik
(74) *Attorney, Agent, or Firm*—Kennedy Covington Lobdell & Hickman, LLP

(57) ABSTRACT

A protective furniture shipment and storage bag is formed as an envelope comprised of inner and outer transparent film layers with protective cushioning foam elements sandwiched therebetween at opposite ends of the envelope to define a furniture viewing window longitudinally between the foam elements. Such bags are fabricated by sandwiching foam elements in spaced relation between two essentially coextensive transparent film layers, folding the sandwiched components along the longitudinal fold line, and heat sealing or otherwise attaching the folded film layers and foam elements at the opposite ends to form the aforedescribed envelope.

14 Claims, 5 Drawing Sheets

PROTECTIVE BAG FOR SHIPMENT AND STORAGE OF ARTICLES OF EQUIPMENT AND METHOD OF FABRICATING SAME

CROSS-REFERENCES TO RELATED APPLICATIONS

The present application is a divisional U.S. patent application claiming priority under 35 U.S.C. §120 from allowed U.S. patent application Ser. No. 09/384,630 filed Aug. 27, 1999 now U.S. Pat. No. 6,189,692, which is a divisional patent application of Ser. No. 09/061,776, filed Apr. 16, 1998, now U.S. Pat. No. 6,006,905, which issued on Dec. 28, 1999, herein incorporated by reference.

BACKGROUND OF THE INVENTION

The present invention relates generally to the shipment and storage of articles of equipment which, for purposes of defining and describing the present invention herein, is intended to encompass any relatively large, bulky article which needs or would benefit from protective packaging during shipment and storage, such as by way of example furniture, home appliances (refrigerators, washers, dryers, etc.), cabinetry, and the like. More particularly, the present invention relates to a novel protective bag adapted for packaging of such articles of equipment, especially furniture, during shipment and storage and a unique method of fabricating such bags. While the present invention is described herein in a presently contemplated embodiment suitable for furniture articles specifically, it is to be understood that the present invention is not limited to use with furniture and may find application for various other articles of equipment as above defined.

Furniture and like equipment manufacturers routinely package finished articles in protective cartons or other packaging to prevent damage during shipment and to protect the articles during storage prior to delivery to the end user. Historically, cardboard cartons had been widely used as a packaging medium for furniture and other such articles, often coupled with the use of plastic film and/or foam material wrapping the article within the carton. In recent years, specialized flexible plastic film bags have come into increasing use as an alternative form of protective packaging, particularly for upholstered furniture such as sofas. One of the benefits of such plastic bags is that transparent plastic film material can be utilized in the fabrication of such bags so that the article contained therein can be readily viewed, which is particularly helpful, for example, in locating individual furniture articles out of a large inventory in a warehouse wherein furniture may be stacked or otherwise stored to a relatively high elevation making it difficult or even impossible for workers to easily view the furniture from the warehouse floor.

However, plastic film alone, even if film of a relatively high thickness, provides little if any cushioning capability and otherwise provides only minimal protection to the furniture article contained therein. To address this problem, some plastic furniture bags are now being manufactured with a layer of compressible foam sheeting surface bonded to the inward side of the plastic film to provide an increased level of protection to the furniture article. Because such foam sheeting is opaque, the foam largely defeats the advantage of using transparent plastic film for ready viewing of the furniture contents of the bag. One version of such a protective furniture bag therefor omits the foam from an area of the bag extending along its entire length to provide a transparent window through which the furniture contents can be viewed, but depending upon where this "window" is situated relative to the furniture article when placed in the bag and depending further on where and how the furniture article is warehoused or otherwise stored, this lengthwise "window" may or may not permit viewing of the furniture contents. Furthermore, the surface bonding of the foam sheet to the transparent plastic film detracts from the use of a shrink wrapping technique to conform the bag to the shape and configuration of the furniture article. Because the foam sheeting does not shrink coextensively with the transparent plastic film, the foam tends to wrinkle dramatically upon shrinkage of the film, making the overall furniture package very unsightly. Additionally, because the foam is characteristically positioned inwardly to be in direct contact with the furniture article, friction between the foam and the furniture may prevent the film from shrinking uniformly.

SUMMARY OF THE INVENTION

It is accordingly an object of the present invention to provide an improved protective bag suitable for shipment and storage of furniture and other articles of equipment which alleviates the above-discussed disadvantages or problems of conventional bags. A more specific object of the present invention is to provide a protective equipment shipment and storage bag having a transparent window through which the article contained therein can be viewed essentially from any angle without regard to the location or disposition of storage. A further object is to provide such a protective bag with one or more protective foam elements which will not restrict shrinkage of transparent film utilized in the fabrication of the bag and will also resist wrinkling or distortion of the foam elements upon such shrinkage. A still further object of the invention is to provide a novel manufacturing methodology by which protective bags meeting these criteria can be efficiently manufactured on a production basis.

Briefly summarized, the protective equipment shipment and storage bag of the present invention basically comprises an envelope closed at one side and at opposite ends to define an interior article containment area and open at an opposite side to define an entrance into the interior containment area. The envelope comprises at least one layer of transparent film, with at least one foam element being attached to the at least one film layer at one end the envelope and terminating at a spacing from the opposite end of the envelope for defining a window area transversely across the envelope for viewing therethrough of an article within the interior containment area.

In a preferred embodiment of the protective bag, the envelope comprises essentially coextensive inner and outer transparent film layers with the foam element being sandwiched between the inner and outer layers. A pair of the foam elements are preferably sandwiched between the inner and outer file layers at the opposite ends of the envelope with a longitudinal spacing between the foam elements defining the window area intermediate the ends of the envelope. The foam elements are preferably of a sheet form and are attached to the film layers essentially only at a selected limited location, e.g. at selected points or along a selected attachment line, to allow a predetermined degree of independent movement of the foam elements and the film layers. Preferably, the foam sheet elements are attached to the film layers essentially only at the opposite ends of the envelope. The film layers may be shrinkable, with the limited attachment of the foam sheet elements thereto serving to resist deformation of the foam elements upon shrinkage of the film layers. The window area defined between the foam elements preferably extends substantially entirely from the one side of the envelope to the opposite side of the envelope, whereby the window will essentially encircle the entire equipment article. If and as necessary, an auxiliary foam element may also be sandwiched between the inner and outer film layers at a selected disposition longitudinally between the pair of foam sheet elements so as to provide additional localized protection to the equipment article, but without substantially restricting the viewing window area.

The methodology provided by the present invention for fabricating such a protective bag basically comprises initially forming a sandwich of two essentially co-extensive layers of transparent film and an element of foam disposed therebetween, and folding the sandwich along a longitudinal fold line. The folded film layers are then attached to each other at the foam element and at a location spaced longitudinally therefrom to form the above-described envelope closed at one longitudinal side and at opposite ends to define an interior containment area and open at an opposite longitudinal side to define an entrance into the interior containment area, with the spacing between the foam element and the spaced location forming a window area transversely across the envelope for viewing therethrough of an article within the containment area.

In a preferred embodiment of the fabrication methodology, a pair of foam elements are sandwiched between the inner and outer film layers and are attached to the folded films layers at spaced locations at the respective foam elements to define the viewing window area therebetween. The foam elements are preferably attached to the film layers essentially only at a selected limited location, e.g., along the opposite longitudinal ends of the envelope, to allow a predetermined movement of the foam elements and the film layers. The sandwich may be preferably formed by feeding two elongate traveling sheets of film in superposed parallel relation, while feeding an elongate traveling sheet of foam therebetween at a slower traveling speed and periodically severing the traveling sheet of foam to form the discrete spaced foam elements. The folded film layers and the spaced foam elements are then attached to one other by sealing the film layers to one another at spaced locations corresponding to the spacing of the foam elements. The traveling film sheets may then be separated at the sealing locations to produce a protective furniture bag between each successive pair of the sealing locations. An auxiliary foam element may be inserted between the inner and outer film layers at a selected disposition to extend longitudinally between the spaced pair of foam elements to selectively provide additional localized protection to a furniture article.

The auxiliary foam elements may be severed into discrete spaced foam elements in a manner similar to that described above for the other foam elements or, alternatively, may be defined as a continuous length of foam. In either case, the auxiliary foam element is sufficiently narrow so as not to significantly obstruct the window area. Also, it is to be noted that the steps of the described method need not be carried out in the order described. For example, the folded sandwich of film layers and foam elements could be prepared and wound into roll form, with the sealing or other attachment of the film and foam to produce individual envelopes being performed thereafter as the sandwich is unwound for use as protective bags. These and other variations and modifications are deemed to be within the scope and substance of the present invention.

DESCRIPTION OF THE PREFERRED EMBODIMENT

Figure 1:
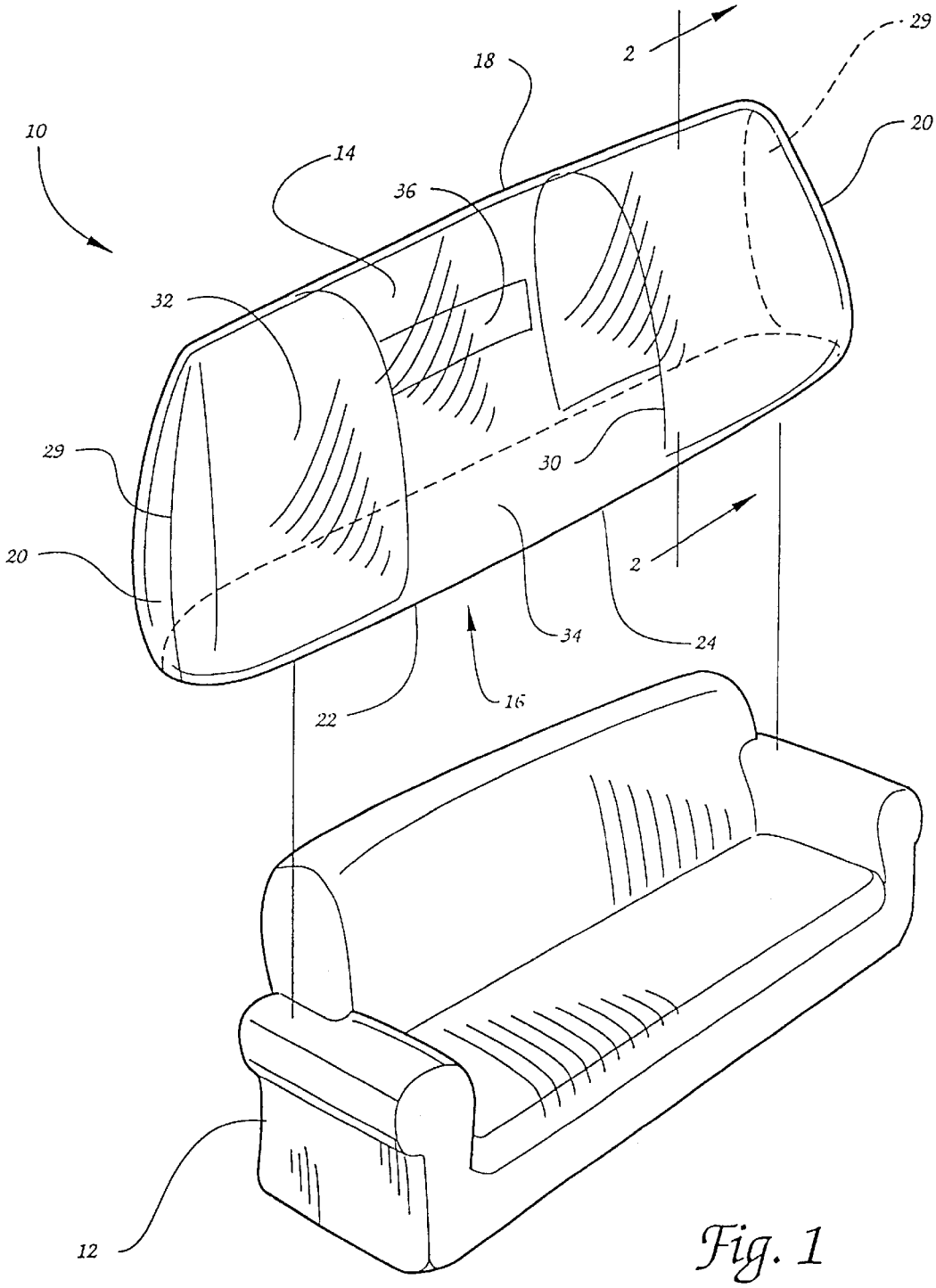
FIG. 1 is a perspective view depicting a furniture article being placed into a protective shipment and storage bag in accordance with a preferred embodiment of the present invention.

Referring now to the accompanying drawings and initially to FIG. 1, a protective shipment and storage bag in accordance with the present invention is shown generally at 10 in a preferred embodiment adapted for use with furniture articles, e.g. an upholstered sofa 12. However, as already indicated above, protective bags in accordance with this invention may also be embodied as appropriate for use with any other article of equipment, such as household appliances or the like. The description and illustration herein of an embodiment for furniture articles is accordingly merely illustrative of the invention and does not limit the scope or substance of the invention.

In FIG. 1, the protective bag 10 is shown in an opened condition for receiving a furniture article, e.g., an upholstered sofa 12. The furniture bag 10 is basically configured as an elongate envelope 14 defining an interior containment area 16 sized sufficiently greater than the sofa (or other furniture article) 12 to fully enclose the furniture article within the interior area 16. As depicted, the furniture bag envelope 14 will in most cases be of a rectangular configuration (although other configurations are contemplated to be possible if and as appropriate), closed at 18 along one longitudinally extending side and at 20 perpendicularly along both opposite ends while being opened at 22 along the opposite longitudinally extending side to define an entrance 24 into the interior containment area 16.

Figure 2:
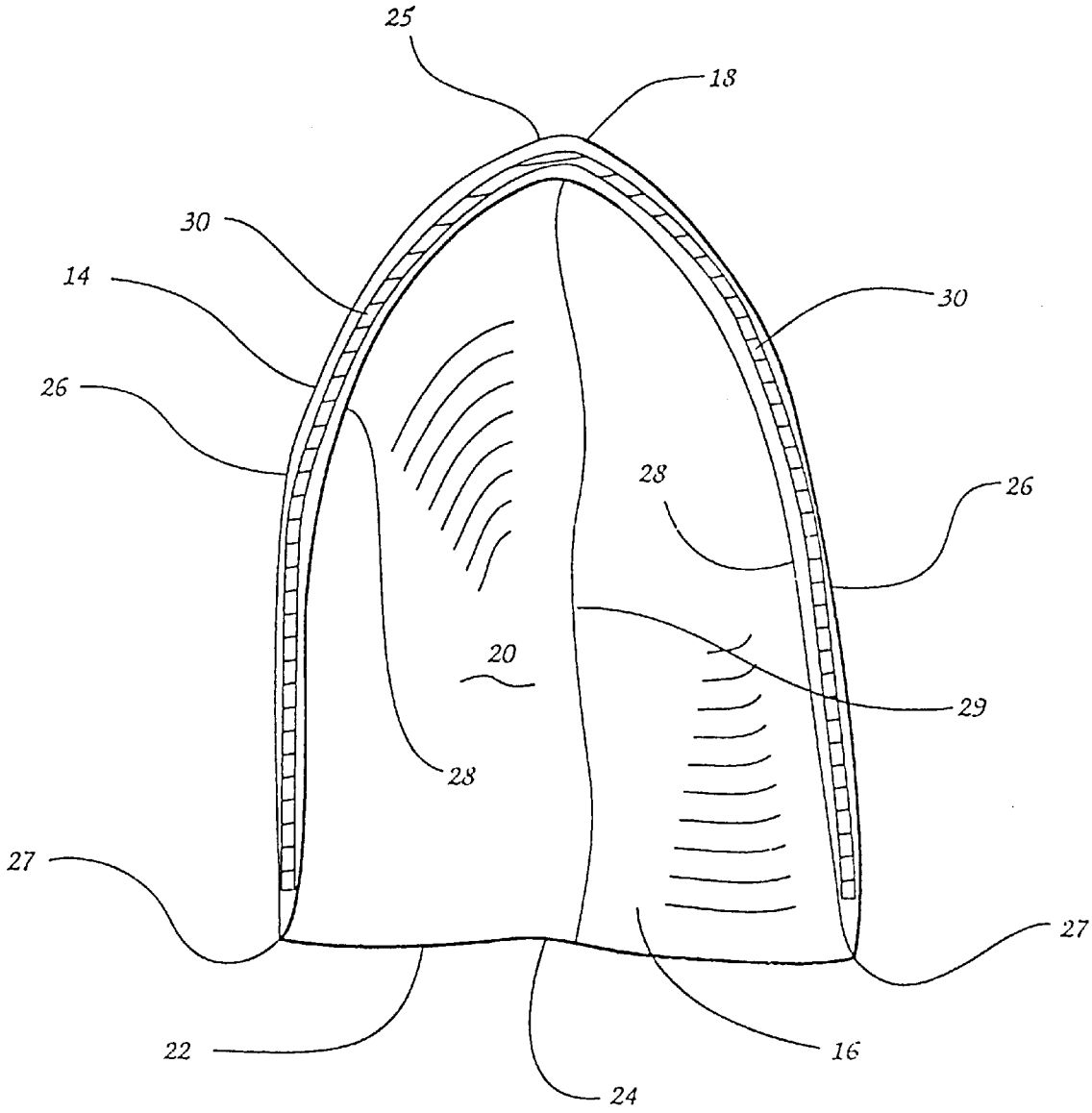
FIG. 2 is a vertical cross-sectional view of the protection furniture bag of FIG. 1, taken along line 2—2 thereof.

With reference additionally to FIG. 2, the furniture bag 10 is preferably fabricated of substantially coextensive outer and inner layers 26, 28 of a transparent thermoplastic film material, preferably a heat shrinkable material such as polyethylene, folded longitudinally at 25 to form the closed lengthwise side 18 and heat sealed together at 29 along the folded end edges to form the closed ends 20. As additionally shown in FIG. 2, the coterminous lengthwise edges of the outer and inner film layers, 26, 28 are also sealed together at 27 to define opposite side edges of the entrance opening 24. A pair of rectangular sections of resilient compressible foam sheeting 30, 32, such as a polyethylene cushioning foam, is sandwiched between the outer and inner film layers 26, 28 at the opposite ends of the envelope 14, the foam sheet elements 30, 32 being sealably attached to the film layers 26, 28 along the end seals 29, respectively, but otherwise being unattached to the film layers.

The rectangular dimension of the foam sheet elements 30, 32 is selected such that each foam sheet element 30, 32 extends substantially the full lateral extent of the envelope 14 from one lengthwise edge seal 27 to the other, but the collective dimension of the foam sheets 30, 32 in the lengthwise direction of the envelope 14 is substantially less than the total lengthwise extent of the envelope 14, thereby leaving a substantial lengthwise spacing between the foam sheet elements 30, 32 within a central region of the envelope 14 which is substantially unoccupied by foam both in the lengthwise and lateral extent of the envelope 14. As will be understood, the foam sheet elements 30, 32 thereby render the opposite ends regions of the envelope 14 substantially opaque, but the central region 34 remains transparent to serve as a window through which the furniture article 12 contained within the bag 10 may be readily viewed.

Optionally, an auxiliary section of compressible foam sheet material 36 may be disposed between the outer and inner film layers 26, 28 lengthwise through a portion of the central region 34 if and as necessary to supply additional protection to a selected area of the furniture article 12, provided that the auxiliary foam section 36 does not significantly obscure the function of the central region 34 as a furniture viewing window, e.g., as depicted representatively by the embodiment of FIG. 1 and 2.

As will thus be understood, once the bag 10 is placed about the furniture article 12 to completely envelope the article 12 within the interior containment area 16, the bag can be subjected to a conventional heat shrinkage procedure to cause the outer and inner film layers 26, 28 to shrink into substantially close conformity to the dimensions and configuration of the furniture article 12, thereby also securing the protective bag 10 in place. Because the foam sheet elements 30, 32 (and the auxiliary foam section 36 if optionally utilized) are substantially unattached to the film layers 26, 28 except along the end seals 29, the film layers 26, 28 shrink freely and unimpeded by the foam elements. At the completion of the heat shrinkage operation, the foam elements 30, 32, 36 remain substantially in their original disposition and relationship relative to the furniture article 12, thereby to provide optimal cushioning protection in the end areas (and any selected optional area covered by the auxiliary foam section 36) which most critically need cushioning protection. While it is preferred that both the inner and outer film layers 26, 28 be heat shrinkable, it is also contemplated that the inner layer 28 may be of nonshrinkable film, particularly if the inner layer 28 is relatively thin, without impairing the functionality of the bag. It is also contemplated to be possible to fabricate the envelope 14 of only a single outer layer of film 28, especially if the envelope 14 need not be heat shrunk or is to be heat shrunk about the article to only a limited degree. In such embodiments, the foam element 30, 32, 36 may be affixed to the outer film layer 28 by seal lines or points as described above or in any other suitable manner.

Since furniture articles such as the sofa 12 are typically shipped and/or stored in an upright disposition resting on end, the disposition of the foam sheet elements 30, 32 within the end regions of the bag envelope 14 should provide effective protection of the furniture article against damage during transit or storage prior to delivery to the ultimate consumer. At the same time, the viewing window provided by the central region 34 unoccupied by the foam sheet elements 30, 32 substantially encircles the entirety of the furniture article so that visual inspection and identification of the furniture article is possible from virtually any viewing perspective.

Referring now to FIGS. 3A, 3B, 4 and 5, an automated production line for fabricating the protective bags 10 on a mass quantity basis is schematically depicted. It will be understood, however, by those persons skilled in the relevant art and industry that other means and methodology for fabricating protective furniture bags having the characteristics of the present invention will also be possible and, hence, the present invention is not to be limited to the particular production methodology and apparatus illustrated.

Figure 3A:
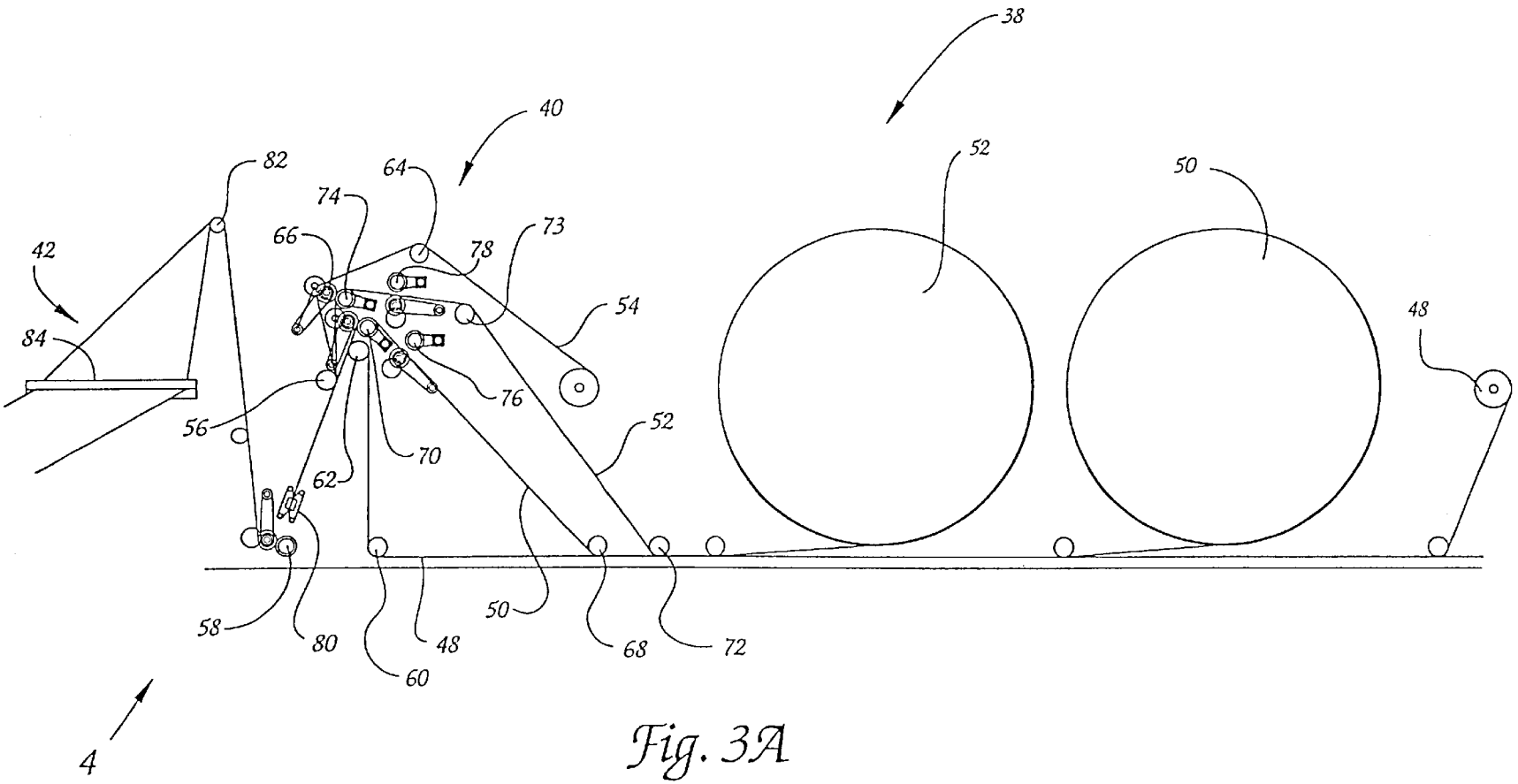
FIGS. 3A and 3B are schematic side elevational views of a manufacturing line for producing the protective furniture bag of FIGS. 1 and 2 in accordance with a preferred process methodology of the present invention.
Figure 3B:
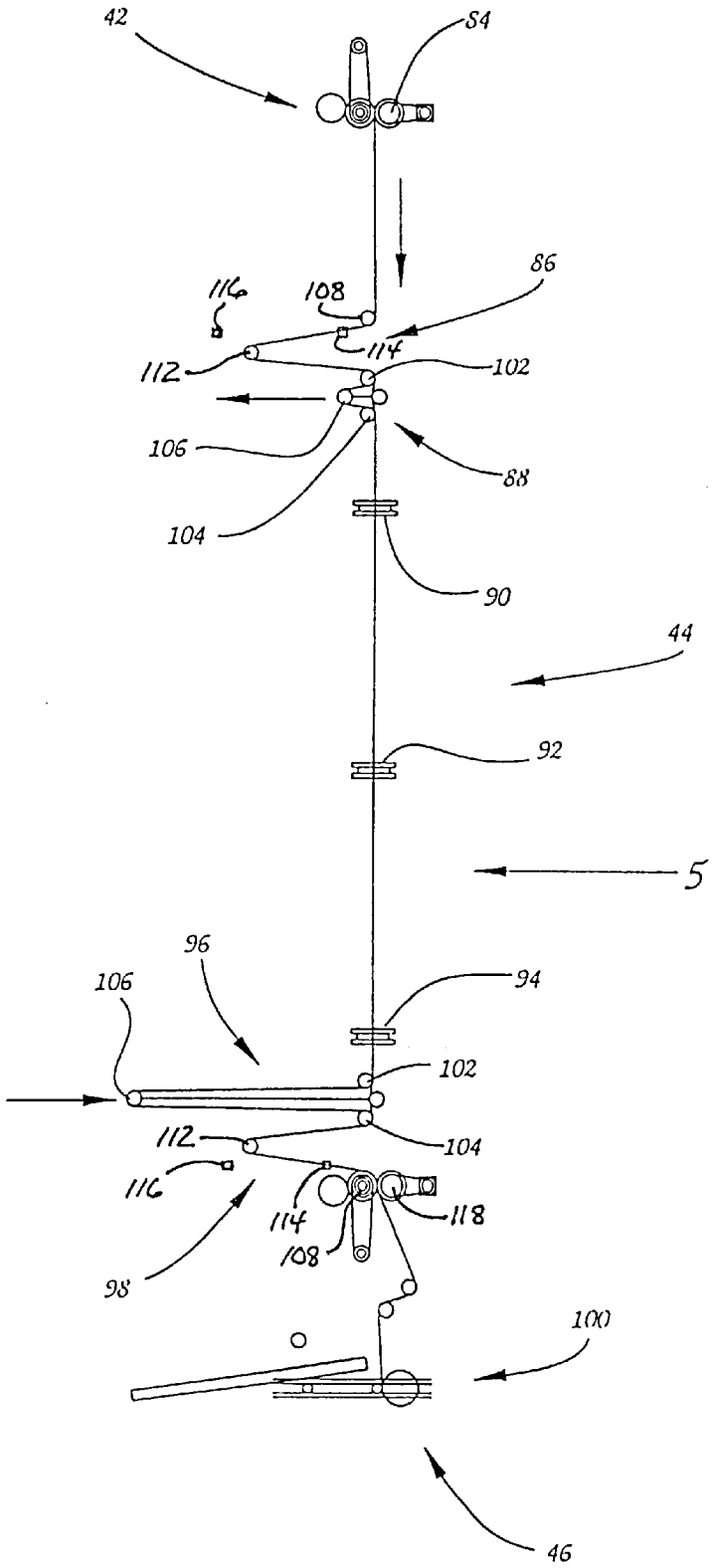

As basically depicted in FIGS. 3A and 3B, the production line comprises a material dispensing station, generally indicated at 38, from which the plastic film and foam sheeting is delivered to an immediately succeeding assembly station, generally indicated at 40, whereat the foam material is cut into the discrete foam elements and sandwiched in correct disposition between the inner and outer film layers. Downstream of the assembly station 40, the sandwiched film and foam components are delivered to a folding station 42 to be continuously folded lengthwise and then delivered to a heat sealing and perforating station, generally indicated at 44 (FIG. 3B), to attach and seal the film and foam components into the form of the aforedescribed envelope 14. The completed bags are then delivered to a take-up station 46 at which the bags 10 are wound into a continuous roll form for shipment and delivery to a furniture manufacturer for use.

More specifically, the dispensing station 38 provides respective roll stands (not shown) for separate supporting a first roll of transparent thermoplastic film 48, a roll of compressibly resilient polymeric foam sheeting 50, an optional second roll of polymeric foam sheeting 52, and a second roll of transparent thermoplastic film 54. The roll stands are situated to deliver the respective film and foam sheets in parallel superposed traveling relation to the assembly station 40, with the foam sheeting 50, 52 traveling between the first and second films 48, 54. The roll stands maybe provided with the capability to support a full reserve roll of each film and foam component to replace the active roll in feeding operation upon exhaustion thereof so that the manufacturing operation can continue on an ongoing essentially uninterrupted basis, but such reserve rolls have been omitted from FIG. 3A for sake of simplicity of illustration.

As more fully explained below, the roll 48 supplies the film which will become the inner layer of film in the finished bags 10, while the roll 54 supplies the film which will become the outer layer of film in the finished bags 10. The roll 50 supplies the foam sheeting which will form the spaced foam elements 30, 32 in the finished bags, while the roll 52 supplies the foam material which will become the auxiliary foam sections 36, if such is optionally utilized. Accordingly, the two film rolls 48, 54 are essentially of the same lateral widthwise dimension and their roll stands are situated to deliver the two film layers in substantially coextensive widthwise registration with one another, the outer film material 54 being of a slightly greater width to provide a small excess margin of film extending laterally beyond the opposite side edges of the inner film 48, thereby to accommodate the subsequent folding step. Additionally, the outer film 54 is of a substantially greater thickness than the inner film 48 to optimize the protective characteristics of the outer layer of film. For example, but without limitation, the outer film 54 maybe of a 5 mil. thickness, whereas the inner film 48 maybe of a 1 mil. thickness.

Correspondingly, the foam sheeting 50 is of a widthwise dimension only slightly less than the widthwise dimension of the inner film 48 and its roll stand is situated to deliver the foam sheeting 50 substantially coextensive with the inner and outer films 48, 54, such that a sufficient lateral margin of the inner film 48 projects beyond the opposite lateral longitudinal edges of the foam sheeting 50 for heat sealing together (as described hereinafter) of the longitudinal side edges of the inner and outer films 48, 54 without sealing engagement of the longitudinal side edges of the foam sheeting 50.

If the bags 10 are to be optionally provided with an auxiliary foam section 36 such as that described above, it will be understood that the roll 52 supplying such foam material will be of a substantially lesser widthwise dimension than the films 48, 54 and the respective roll stand for the foam sheeting 52 is accordingly situated to deliver the foam sheeting at a selected desired disposition relative to the other components. For example, to produce the bag 10 of FIG. 1, wherein the auxiliary foam section 36 is disposed more closely spaced to the rearward lengthwise edge seal 27 of the bag 10 (as viewed from the prospective shown in FIG. 1), the roll 52 is feed at a rearward offset to the longitudinal center line of the other film and foam components 48, 50, 54.

At the assembly station 40, the film and foam components 48, 50, 52, 54 are directed about respective feed rolls to a common idler roll 56 at which the film and foam components are placed into face-abutting superposed parallel relation for common delivery therefrom to and about downstream rolls, at least one of which will be positively driven, e.g., as representatively indicated by the driven feed roll 58. Specifically, the inner film 48 is directed about idler rolls 60, 62 and therefrom to the common idler rolls 56. The outer film 54 is directed about idler rolls 64, 66 and therefrom to the common idler rolls 56. The foam sheeting 50 is directed about an idler roll 68 to a driven roll 70 and therefrom to the idler roll 56. Similarly, the foam sheeting 52 is directed about idler rolls 72, 73 to a driven roll 74 and therefrom to the idler roll 56.

As will be understood, the foam material of each roll 50, 52 is in the form of a continuous foam sheet and, hence, in order to create the discrete spaced foam elements 30, 32 from the foam sheeting 50 and the auxiliary foam sections 36 from the foam sheeting 52, a first selectively actuable perforating knife 76 is provided at the assembly station 40 adjacent the travel path of the foam sheeting 50 between the idler roll 68 and the driven roll 70 to form a perforation line laterally across the width of the traveling foam sheeting 50 at periodic intervals and, similarly, another selectively actuable perforating knife 78 is disposed adjacent the travel path of the foam sheeting 52 between the idler roll 73 and the driven roll 74 to periodically form a line of perforations laterally across the full width of the traveling foam sheeting 52.

To ensure that the foam sheet elements 30, 32 and the auxiliary foam sections 36 are inserted between the traveling films 48, 54 in proper relationship to one another, the driven feed roll 58 by which traveling movement is imparted simultaneously to the films 48, 54 and the driven rolls 70, 74 by which traveling movement is imparted respectively to the foam sheeting 50, 52 upstream of the driven roll 58 are driven at selectively differential respective speeds, the feed roll 58 having a greater peripheral speed than both driven rolls 70, 74, while the driven roll 70 has a greater peripheral speed than the roll 74.

Figure 4:
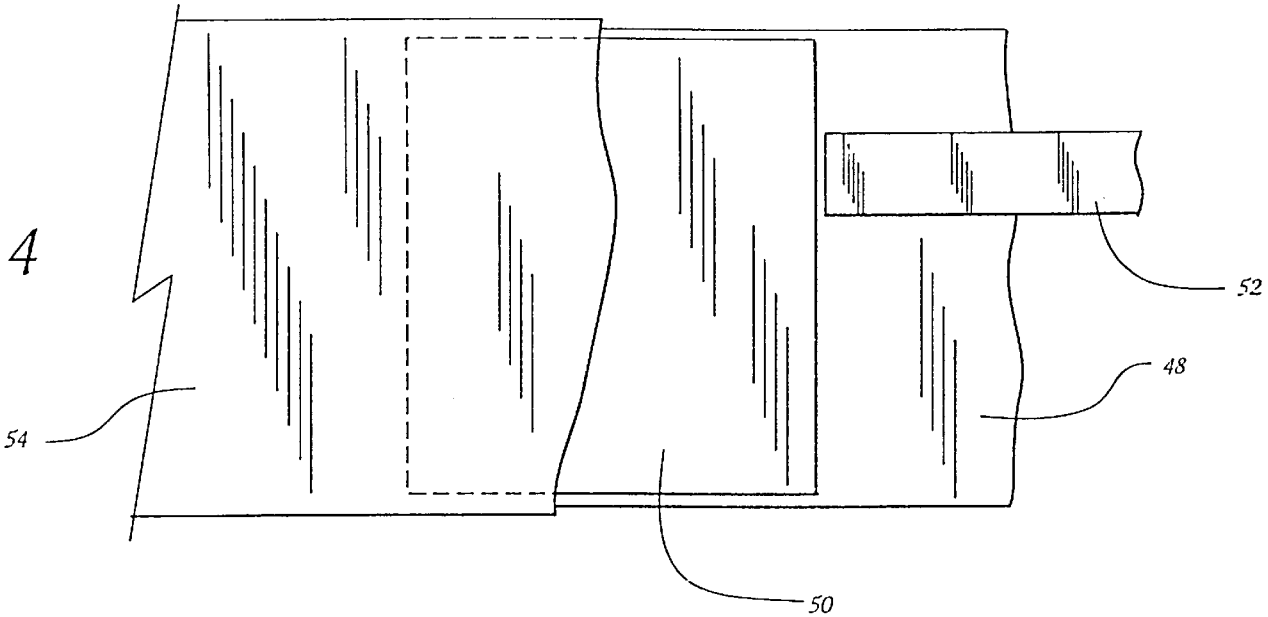
FIG. 4 is a plan view depicting the assembly of the components of the furniture bag at the stage in the manufacturing line indicated at 4 in FIG. 3A.

Thus, as the perforated foam sheeting 50 reaches the idler roll 56 and is then subjected to the greater traveling speed of the two films 48, 54 by being frictionally sandwiched therebetween, the foam sheeting separates along the immediately trailing perforation just theretofore formed by the knife 76 and is carried forward with the films 48, 54 at their greater traveling speed. This process continues repeatedly to create discrete spaced foam sheet elements 30, 32 from the incoming perforated sheeting 50. Likewise, the incoming foam sheeting 52 is repeatedly separated in the same manner along the perforations formed by the intermittently actuated knife 78, the differential speeds of the driven rolls 70, 74 causing the discrete auxiliary foam sections 36 to be inserted between the films 48, 54 in the longitudinal spacings between the discrete foam sheet elements 30, 32. FIG. 4 schematically depicts the relationship between the thusly sandwiched films 50, 54 and foam elements 30, 32 and sections 36 at this stage of the process line indicated at 4 in FIG. 3A.

As the thusly formed sandwich of the traveling films 50, 54 and the discrete, spaced foam sheet elements 30, 32 and intervening auxiliary foam sections 36 travels forwardly from the idler roll 56 to the driven roll 58, sealing devices 80 disposed at the laterally opposite longitudinal side edges of the traveling films 48, 54, form a continuous seal between the overlapping edge margins of the two films 48, 54, without capturing the edges of the foam sheet elements 30, 32 within the seals due to the narrower widthwise dimension of the foam sheeting 50.

The thusly assembled film and foam components travel forwardly from the driven roll 58 to the folding station 42 at which the film is directed about a first roll 82 rotating about an axis parallel to all of the driven and idler rolls of the assembly station 40 and then about a downstream folding roll 84 oriented to rotate about an axis perpendicular to the roll 82, whereby the assembled sandwich of the films 48, 54 and the foam elements 30, 32, 36 is folded along the longitudinal centerline of the films 48, 54 and the foam elements 30, 32, thereby disposing the edge seals 27 of the two films 48, 54 in immediately adjacent disposition to one another. The folding roll 84 is preferably driven to direct the folded film and foam components downstream to the sealing and perforating station 54.

As best seen in FIG. 3B, the sealing and perforating station 54 basically comprises in succession an upstream tension control device 86, an upstream accumulator device 88, a series of three film clamping and sealing units 90, 92, 94, a downstream accumulator device 96, a downstream tension control device 98, and a winding take-up arrangement 100.

By means of the accumulator devices 88, 96 at opposite upstream and downstream sides of the clamping/sealing units 90, 92, 94, the traveling assembly of film and foam components may be periodically isolated in a stationary disposition therebetween for operation of the clamping/sealing units. More specifically, while the respective rolls at the assembly and folding stations 40, 42 and the winding take-up arrangement 100 operate continuously without interruption to act on the assembled film and foam components at an essentially constant rate of traveling speed, the accumulator devices 88, 96 operate in opposition to one another. Each accumulator device 88, 96 is of a generally conventional construction comprising a pair of stationary idler rolls 102, 104 between which an accumulator roll 106 is reciprocally movable toward and away from the stationary idler rolls 102, 104 to take-up an accumulation of the traveling sandwiched material while traveling away from the idler rolls and to pay out such accumulation when moving in reverse toward the idler rolls.

At the start of a clamping/sealing cycle, the upstream accumulator device 88 is substantially emptied of any accumulation of the incoming sandwiched film and foam material while the downstream accumulator device 96 has accumulated the sandwiched film and foam material to substantially its full capacity. At this point, the length of sandwiched film and foam material between the two accumulators 88, 96 remains substantially stationary while the upstream accumulator device 88 accumulates an incoming length of the traveling sandwiched film and foam material by movement of the accumulator roll 106 away from the idler rolls 102, 104 and simultaneously the downstream accumulator device 96 pays out its previously accumulated quantity of film and foam material by reverse movement of its accumulator roll 106 toward its idler rolls 102, 104.

Figure 5:
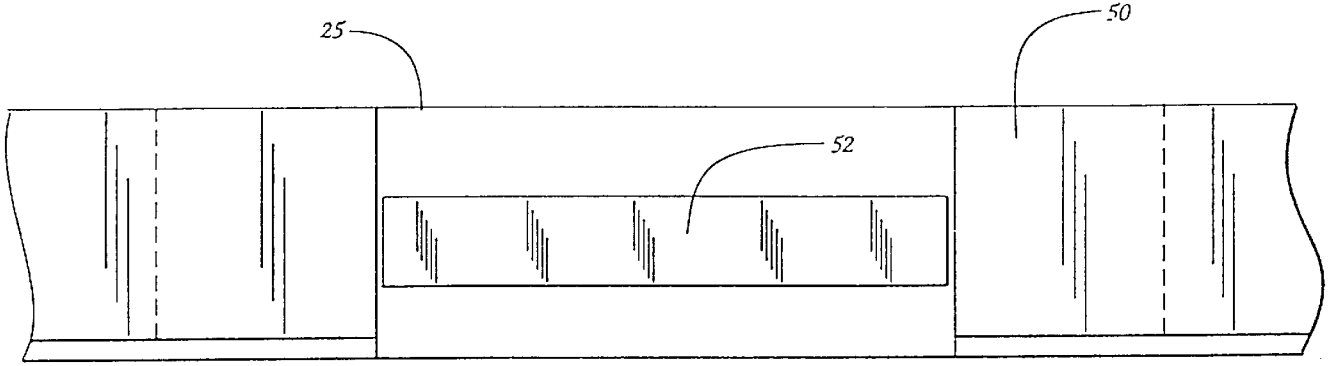
FIG. 5 is another plan view depicting the assembly of the components of the furniture bag at the stage in the manufacturing line indicated at 5 in FIG. 3B.

While the intervening length of the film and foam material remains stationary, the sealing and clamping units 90, 92, 94 are actuated to form heat sealed perforations across the full widthwise extent of the material, thereby to form the end seals 29 of successive bags 10. The proper disposition of the foam sheet elements 30, 32 relative to the clamping and sealing units 90, 92, 94 may be achieved by a microprocessor-based control of the accumulators or, alternatively, using appropriate photoelectric sensors in association with the clamping and sealing units to detect the proper disposition of the foam elements 30, 32 relative to the clamping/sealing units 90, 92, 94. Of course, any other appropriate control system could also be utilized, as will be apparent to persons skilled in the art. FIG. 5 schematically depicts the relationship between the thusly heat sealed films 50, 54 and foam elements 30, 32 at this stage of the process line indicated at 5 in FIG. 3B.

Upon completion of the clamping/sealing operation of the units 90, 92, 94 the upstream accumulator device 88 will have accumulated essentially its full capacity of sandwiched film and foam material incoming from the folding station 42, while the downstream accumulator device 96 will have substantially emptied its previous accumulation of sandwiched film and foam material by paying out the accumulation to the winding take-up arrangement 100. The clamping and sealing units 90, 92, 94 are then opened and, as the accumulator devices 88, 96 reverse their respective operations, the downstream accumulator device 96 accumulates the previously stationary length of sandwiched film and foam material from the clamping/sealing units 90, 92, 94, while the upstream accumulator device 88 discharges its accumulation of material to the sealing and clamping units 90, 92, 94, whereupon the clamping and sealing cycle is repeated.

Throughout this series of steps in the operation of the sealing and perforating station 54, the upstream and downstream tension control devices 86, 98, act to maintain a substantially uniform tension in the sandwiched film and foam material. Specifically, each tension control device 86, 96 includes a stationary idler roll 108 spaced adjacently from one idler roll 102 or 104 of the adjacent associated accumulator 88 or 96, 110 with a dancer roll 112 disposed therebetween for movement toward and away therefrom in response to increases and decreases in the prevailing tension in the sandwiched film and foam material. Opposing limit switches 114, 116 are disposed in the path of movement of the dancer roll 112 to detect tension fluctuations exceeding predetermined limits. The limit switches 114, 116 associated with the upstream tension control device 86 are connected with a suitable microprocessor, computer or other controller (not shown) to actuate corrective adjustments in the driven speed of the driven folding roll 84 in response to any such excessive tension fluctuations. Similarly, the limit switches 114, 116 associated with the downstream tension control device 98 act through the controller to actuate corrective speed adjustments in the driven speed of a driven roll 118 at the downstream side of the tension control device 98.

As will thus be understood, the described production methodology and apparatus advantageously permits protective furniture bags 10 to be fabricated efficiently and economically on an ongoing continuous basis, with the output of the sealing and perforating station 44 being collected in roll form for delivery to a furniture manufacturer. The thusly formed bags 10 are easily withdrawn from the roll by the furniture manufacturer and separated along the widthwise perforations into individual furniture bags for ready packaging and shipment of furniture articles in the manner aforedescribed. Advantageously, the foam sheet elements 30, 32 provide optimal cushioning protection at the opposite ends of the furniture bags 10 substantially without any endwise region of the bags being without foam cushioning, while the intermediate section of each bag provides a transparent window substantially surrounding the entire furniture article excepting only any portion of the furniture article covered by the optional auxiliary foam section 36.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method of fabricating a protective bag for shipment and storage of an article of equipment, comprising:

forming a sandwich of two essentially coextensive layers of transparent film and an element of foam disposed therebetween;

folding the sandwich along a longitudinal fold line; and attaching the folded film layers at an and of the foam element and at a location longitudinally spaced therefrom to form an envelope closed at one longitudinal side and at opposite ends to define an interior containment area and open at an opposite longitudinal side to define an entrance into the interior containment area, with only the end of the foam element being captured in sealing attachment to the folded film layers and with the spacing between the foam element and the spaced location forming a window area transversely across the envelope for viewing therethrough of an article within the interior containment area.

2. A method of fabricating a protective bag for shipment and storage of an article of equipment according to claim 1, and further comprising attaching the foam element to the film layers essentially only at a selected limited location to allow a predetermined degree of independent movement of the foam element and film layers.

3. A method of fabricating a protection bag for shipment and storage of an article of equipment according to claim 2, and further comprising attaching the foam element to the film layers at one longitudinal end of the envelope.

4. A method of fabricating a protective bag for shipment and storage of an article of equipment according to claim 1, wherein forming the sandwich includes inserting an auxiliary foam element between the inner and outer film layers at a selected disposition longitudinally between the pair of foam elements.

5. A method of fabricating a protective bag for shipment and storage of an article of equipment according to claim 1, wherein forming the sandwich comprises feeding two elongate traveling sheets of film in superposed parallel relation while feeding an elongated traveling sheet of foam therebetween at a slower traveling speed and periodically severing the traveling sheet of foam to form the foam element.

6. A method of fabricating a protective bag for shipment and storage of an article of equipment according to claim 5, wherein attaching the folded film layers comprises sealing the film layers to one another at spaced locations and separating the traveling film sheets at the sealing locations to produce a bag between each successive pair of sealing locations.

7. A method of fabricating a protective bag for shipment and storage of an article of equipment, comprising:

forming a sandwich of two essentially coextensive layers of transparent film and an element of foam disposed therebetween at a spacing along a longitudinal dimension of the film layers;

folding the sandwich along a longitudinal fold line; and attaching the folded film layers at spaced locations at an end of each of the spaced foam elements to form an envelope closed at one longitudinal side and at opposite ends to define an interior containment area and open at an opposite longitudinal side to define an entrance into the interior containment area, with only the ends of the foam elements being captured in sealing attachment to the folded film layers and with the spacing between the foam elements forming a window area for viewing therethrough of an article within the interior containment area.

8. A method of fabricating a protective bag for shipment and storage of an article of equipment according to claim 7, and further comprising attaching the foam elements to the film layers essentially only at a selected limited location to allow a predetermined degree of independent movement of the foam elements and film layers.

9. A method of fabricating a protection bag for shipment and storage of an article of equipment according to claim 8, and further comprising attaching the foam elements to the film layers at the opposite longitudinal ends of the envelope.

10. A method of fabricating a protective bag for shipment and storage of an article of equipment according to claim 7, wherein forming the sandwich includes inserting an auxiliary foam element between the inner and outer film layers at a selected disposition longitudinally between the pair of foam elements.

11. A method of fabricating a protective bag for shipment and storage of an article of equipment according to claim 7, wherein forming the sandwich comprises feeding two elongate traveling sheets of film in superposed parallel relation while feeding an elongated traveling sheet of foam therebetween at a slower traveling speed and periodically severing the traveling sheet of foam to form the discrete spaced foam elements.

12. A method of fabricating a protective bag for shipment and storage of an article of equipment according to claim 11, wherein attaching the folded film layers comprises sealing the film layers to one another at spaced locations corresponding to the spaced foam elements, and separating the traveling film sheets at the sealing locations to produce a bag between each successive pair of sealing locations.

13. A method of fabricating a protective bag for shipment and storage of an article of equipment, comprising:

forming a sandwich of two essentially coextensive layers of transparent film and an element of foam disposed therebetween at a spacing along a longitudinal dimension of the film layers;

folding the sandwich along a longitudinal fold line; and attaching the folded film layers at spaced locations at the spaced foam elements to form an envelope closed at one longitudinal side and at opposite ends to define an interior containment area and open at an opposite longitudinal side to define an entrance into the interior containment area with the spacing between the foam elements forming a window area for viewing therethrough of an article within the interior containment area;

wherein forming the sandwich comprises feeding two elongate traveling sheets of film in superposed parallel relation while feeding an elongated traveling sheet of foam therebetween at a slower traveling speed and periodically severing the traveling sheet of foam to form the discrete spaced foam elements.

14. A method of fabricating a protective bag for shipment and storage of an article of equipment according to claim 13, wherein attaching the folded film layers comprises sealing the film layers to one another at spaced locations corresponding to the spaced foam elements, and separating the traveling film sheets at the sealing locations to produce a bag between each successive pair of sealing locations.

* * * * *